US007022956B2

(12) United States Patent
Greenstreet

(10) Patent No.: US 7,022,956 B2
(45) Date of Patent: Apr. 4, 2006

(54) MICROWAVE OVEN FOOD-STIRRER

(76) Inventor: David Mark Greenstreet, Little Orhard, Kiln Road, Prestwood, Great Missenden, Buckinghamshire (GB)

( * ) Notice: Subject to any disclaimer, the term of this patent is extended or adjusted under 35 U.S.C. 154(b) by 86 days.

(21) Appl. No.: 10/416,881

(22) PCT Filed: Dec. 13, 2001

(86) PCT No.: PCT/GB01/05553

§ 371 (c)(1),
(2), (4) Date: May 19, 2003

(87) PCT Pub. No.: WO02/51210

PCT Pub. Date: Jun. 27, 2002

(65) Prior Publication Data

US 2004/0025706 A1 Feb. 12, 2004

(30) Foreign Application Priority Data

Dec. 21, 2000 (GB) ..... 0031231

(51) Int. Cl.
*H05B 6/78* (2006.01)

(52) U.S. Cl. ..... 219/726; 219/754; 219/763; 99/DIG. 14; 99/348

(58) Field of Classification Search ..... 219/726, 219/725, 754, 762, 763; 99/348, 451, DIG. 14; 366/146, 228, 231
See application file for complete search history.

(56) References Cited

U.S. PATENT DOCUMENTS 4,751,357 A * 6/1988 Boulard ..... 219/726

FOREIGN PATENT DOCUMENTS

| | | | |
|---|---|---|---|
| EP | 0 312 373 | * | 4/1989 |
| GB | 2 159 027 | * | 11/1985 |
| GB | 2 300 095 | * | 10/1996 |
| GB | 2 322 271 | * | 8/1998 |
| WO | 93/10648 | * | 5/1993 |

* cited by examiner

*Primary Examiner*—Phillp H. Leung

(57) ABSTRACT

A retrospectively-fitted multi-configurable microwave oven accessory the purpose of which is to provide an automated stirring capability of foodstuffs by use of the internal rotary plate of a microwave oven to provide a relative motion of the foodstuff and which is configured from a roof rail, a series of roof fittings and a series of stirring implements and where necessary may employ a food receptacle securing method. The device is shown at FIG. 7 of the attached drawings.

17 Claims, 7 Drawing Sheets

MICROWAVE OVEN FOOD-STIRRER - FIGURE 1
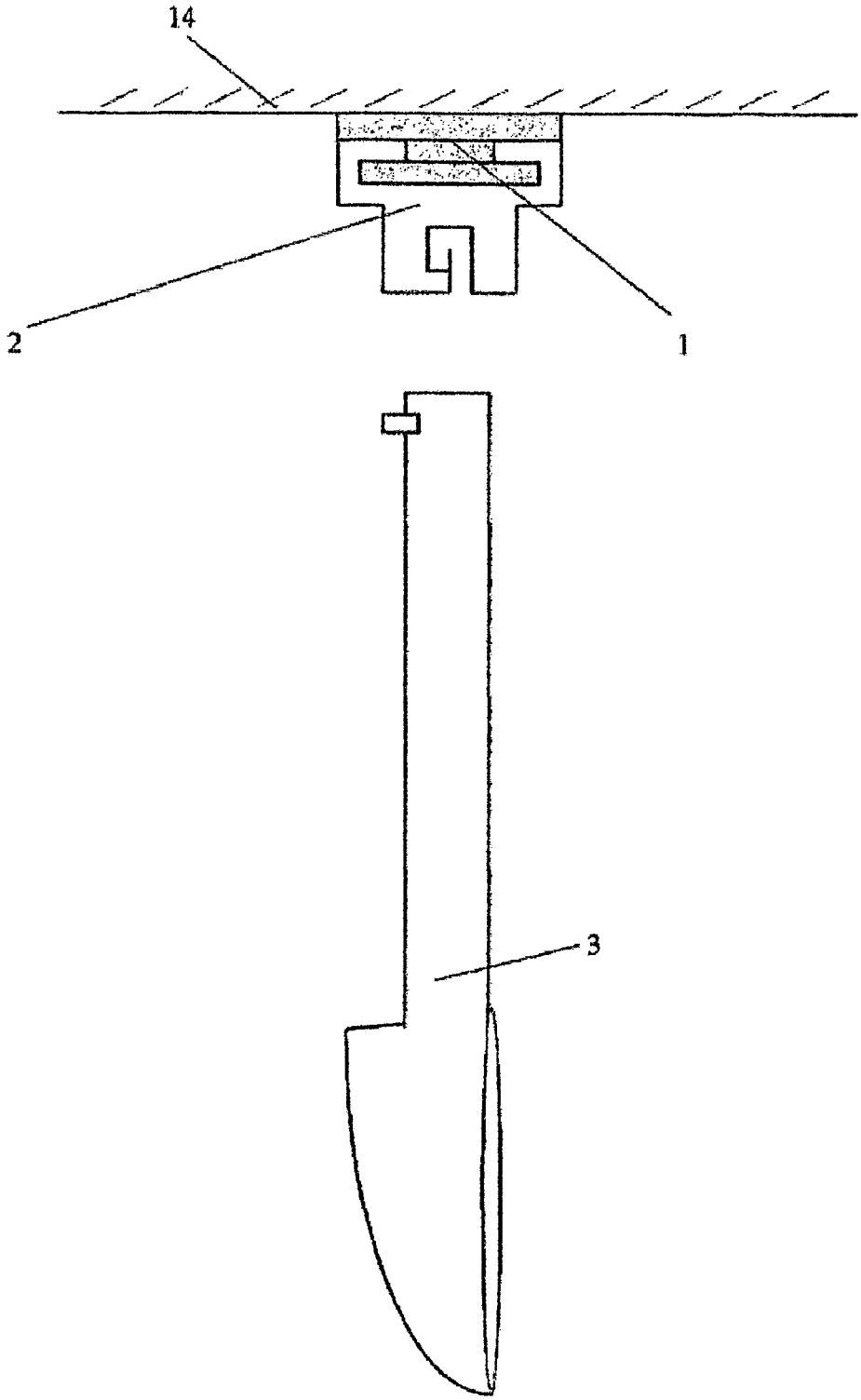

MICROWAVE OVEN FOOD-STIRRER - FIGURE 2
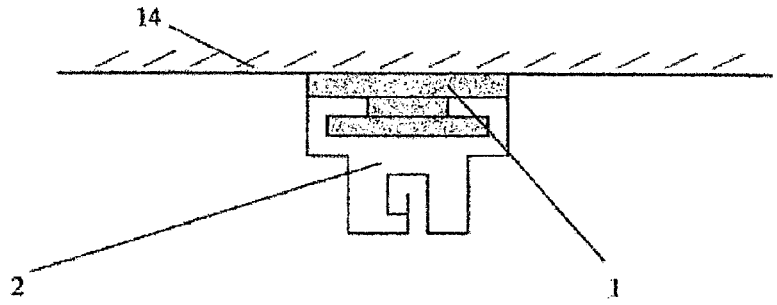
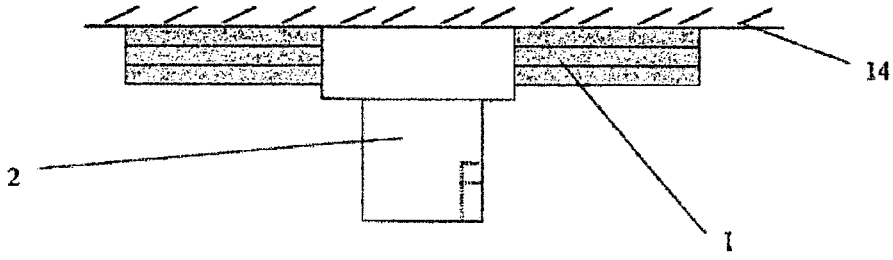

MICROWAVE OVEN FOOD-STIRRER - FIGURE 3
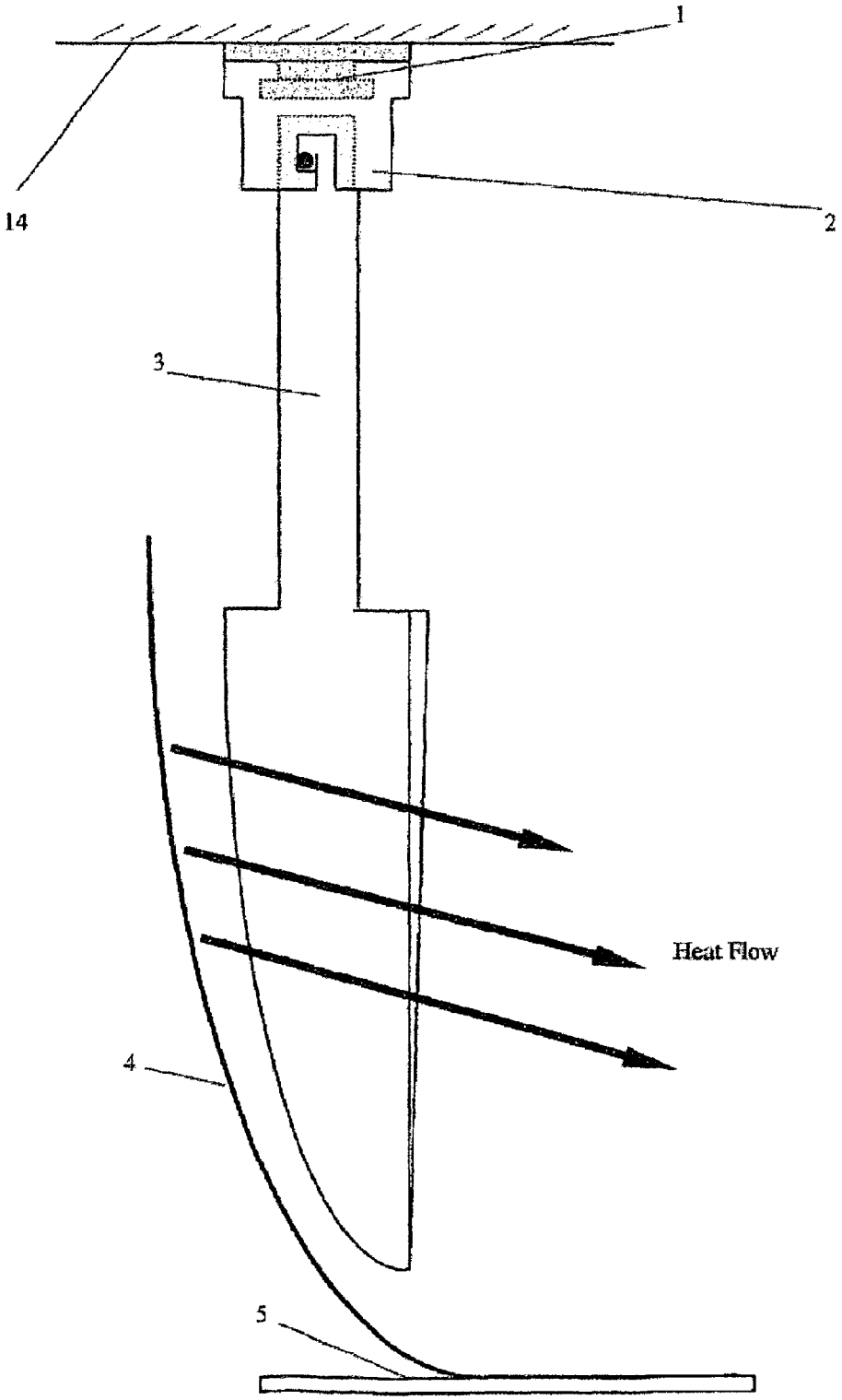

MICROWAVE OVEN FOOD-STIRRER - FIGURE 4
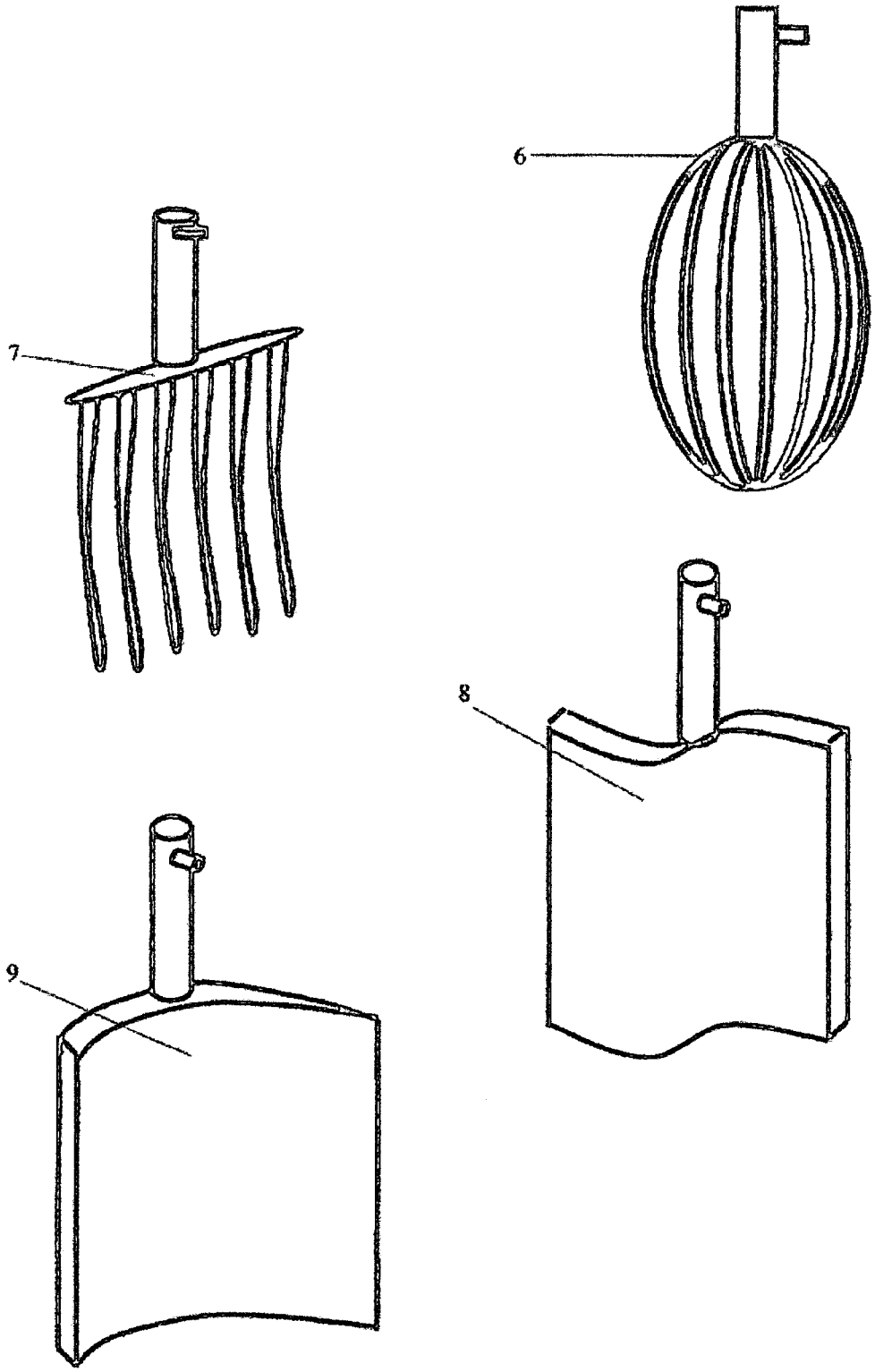

MICROWAVE OVEN FOOD-STIRRER - FIGURE 5
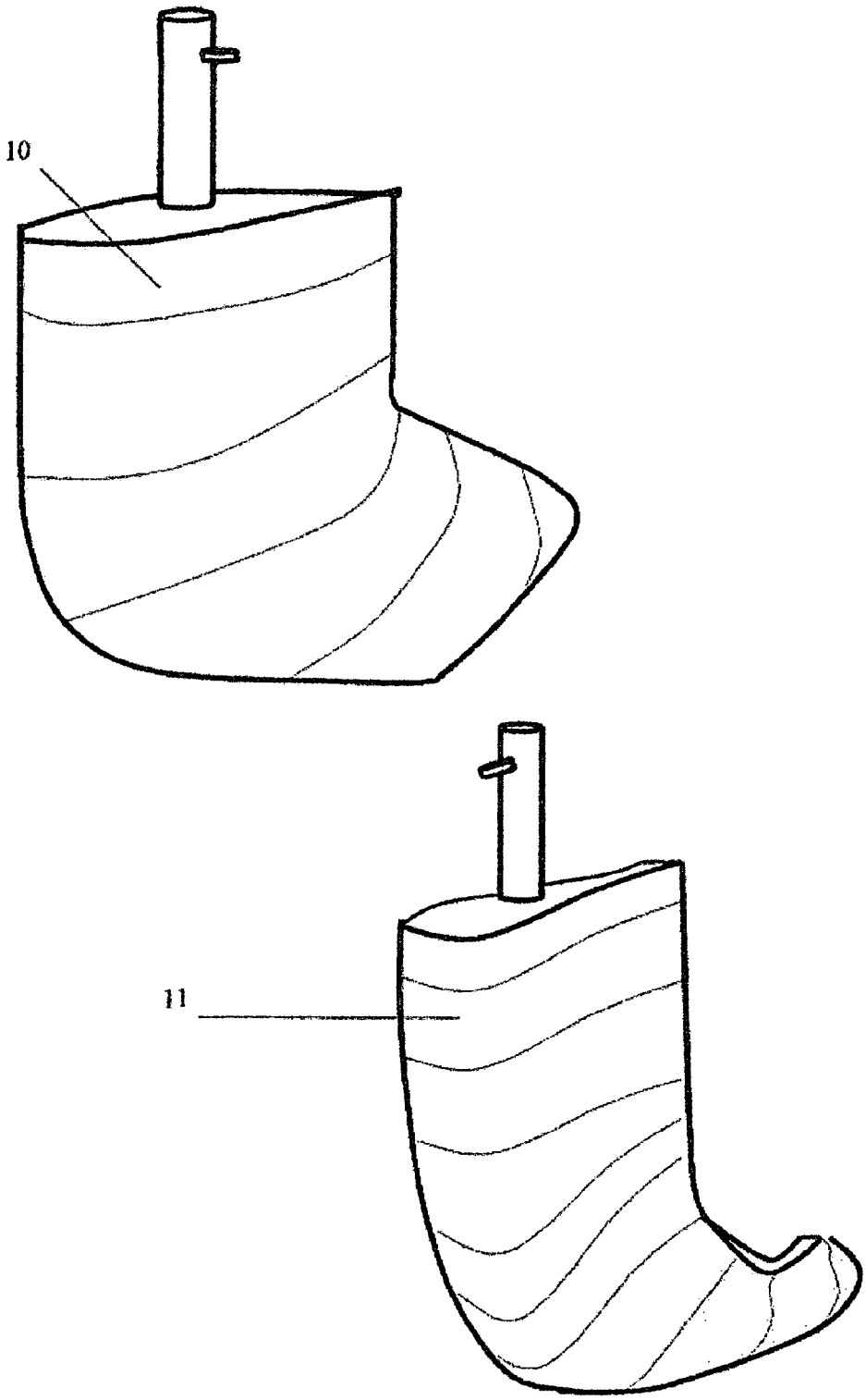

MICROWAVE OVEN FOOD-STIRRER - FIGURE 6
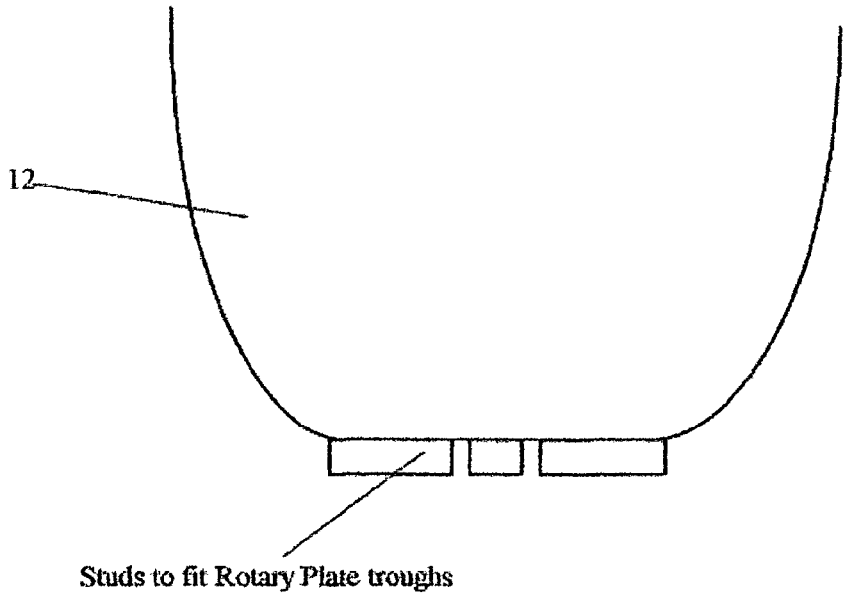
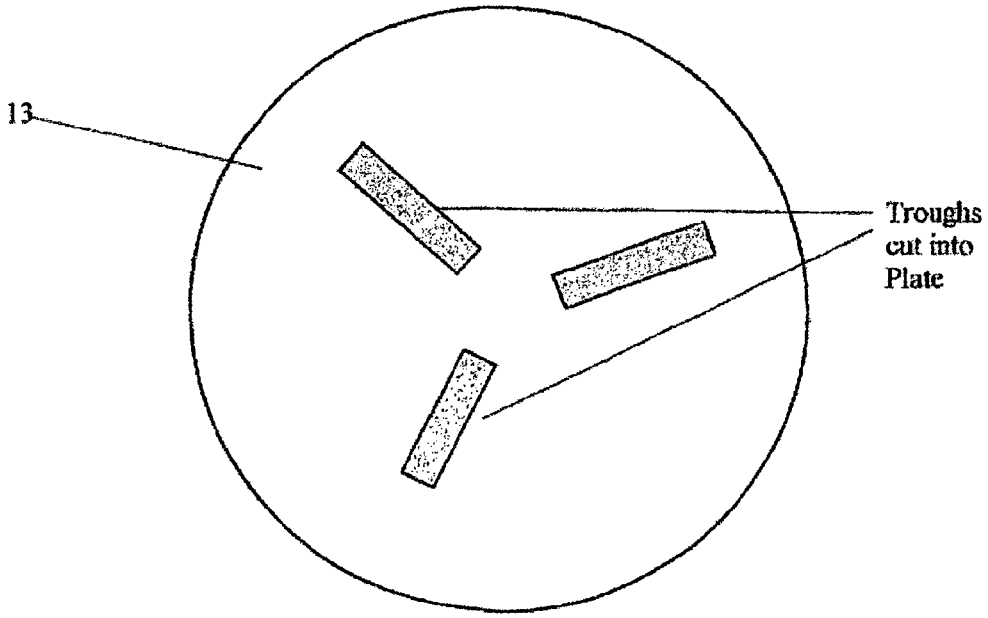

MICROWAVE OVEN FOOD-STIRRER - FIGURE 7
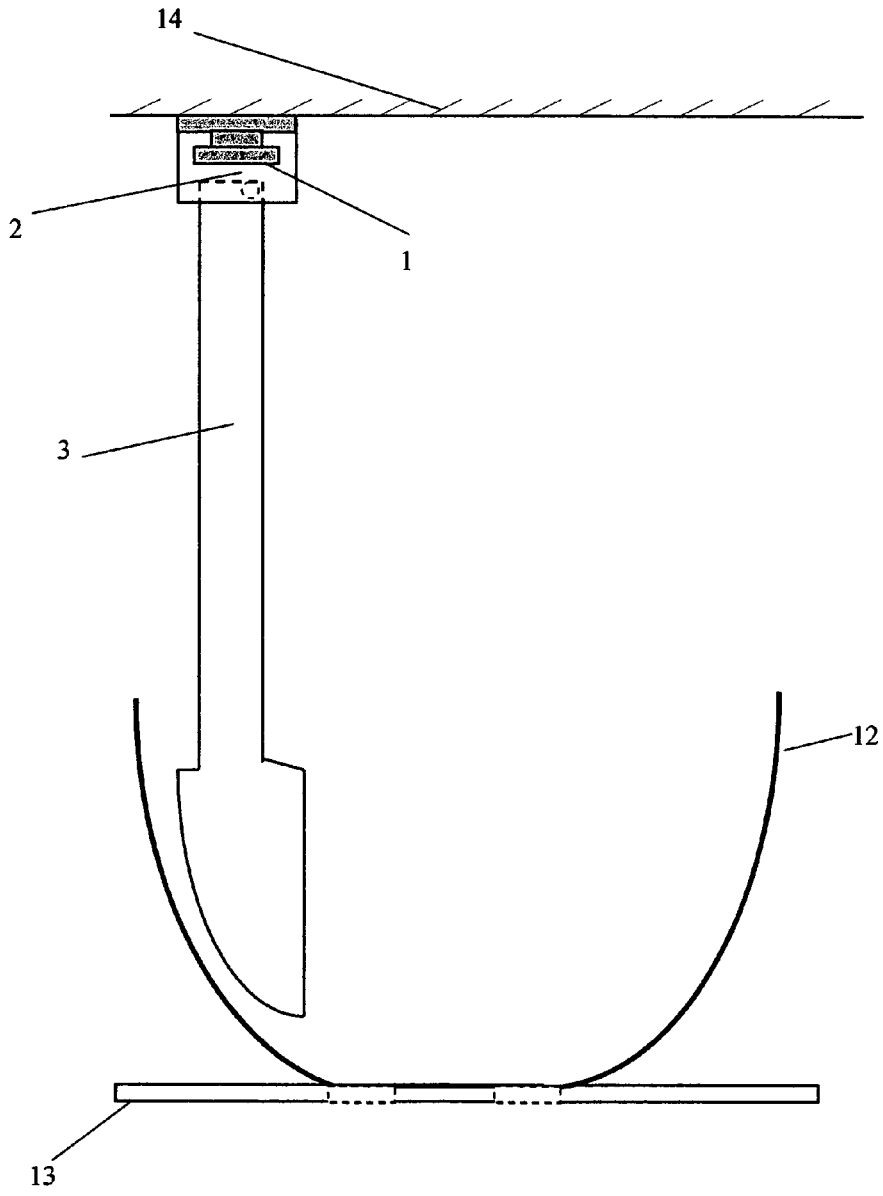

MICROWAVE OVEN FOOD-STIRRER

This invention relates to a retrospectively-fitted accessory to microwave ovens for use as a food-stirring device (hereafter referred to as a Microwave Oven Food-Stirrer).

CROSS-REFERENCE TO RELATED APPLICATIONS

This application is filed with the USPTO via the designation of the USA for entry into the National Phase for PCT International Application Number PCT/GB01/05553.

PCT/GB01105553 was filed with WIPO on 13 Dec. 2001 and claims the priority date of a National Application filed in Great Britain (Application Number GB0031231.4) on 21 Dec. 2000.

PCT/GB01/05553 has also designated Europe as a Region for the appliance of the PCT. The European Patent Office has given EPO Application Number 01271787.2 to this application.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION

REFERENCES

A. GB 2159027A (Thom EMI) dated Jun. 15, 1984.
B. EP0312373 A (Raytheon) dated Oct. 14, 1988.
C. GB 2230409 (Burton) dated Mar. 29, 1989.
D. U.S. Pat. No. 5,151,569A (Samsung Electronics Co Ltd) dated May 21, 1991.
E. WO 9310648 A (Jannaway) dated Nov. 16, 1992.
F. GB 2300095A (Yinn Haur Co Ltd) dated Apr. 5, 1995.
G. GB 2322271 A (Jones) dated Feb. 15, 1997.
H. U.S. Pat. No. 4,751,357 (Boulard) dated Sep. 25, 1986.

It has been known for some time that the distribution of energy within a microwave oven is not uniform and thus the even distribution of heat through food stuffs being cooked in a microwave oven is difficult to achieve. The development of a rotary plate as part of the internal features of the cavity of a microwave oven went some way to overcoming the inconveniences caused by this and the referenced prior art indicates that a device for permitting the practical stirring of food stuffs during the cooking or reheating of them in a microwave oven has been an aspiration for some time. However, through the limited success of a rotary plate in achieving a uniform heat distribution and the complexities and impracticalities of previous food stirring device ideas, it is still a fact today that while cooking or re-heating either high or low viscosity foods (ie, stews, rice puddings, sauces, soups etc) or beverages in a microwave oven, there is a need to interrupt the cooking process periodically in order to stir the food so as to ensure an even distribution of heat through it.

The idea of a Microwave Oven Food-Stirrer was born from the need for mechanism to permit stirring of food stuffs during the cooking or reheating of them in a microwave oven so as to achieve a far more even distribution of energy throughout the food and allow the cooking period to be continuous (a procedure recommended for best results in many dishes). Furthermore, the mechanism to meet this purpose would need to be uncomplicated in design, be, as a manufactured product, compatible for use with any size of domestic microwave oven having a rotary plate as part of its internal features, compatible for use with an extremely wide range of food/beverage receptacles including those that are narrow, easy for a layman to operate and clean, provide insignificant obstruction to the placement of items within the microwave oven cavity both when in use and when not in use and be able to be retrospectively fitted by a layman to an existing microwave oven. A Microwave Oven Food-Stirrer is a device to facilitate this function.

While prior art at References A to H has attempted to meet the functionality offered by the Microwave Oven Food-Stirrer, it has failed through the complexities and/or inadequacies of its design making it impractical for use in a microwave oven for one or more of the following reasons:

a. The operation of it, in particular preparation for use, hampering the overall cooking process.
b. The obstruction caused by it to placement of additional items (primarily a receptacle) within the oven cavity.
c. The fact that it may be used with a very limited design of receptacle only; in particular, it is incompatible with the use of tall, narrow receptacles (jugs, beakers etc).
d. Inconvenience in its operation due to its non-ergonomic characteristics.

For example:

a. The device at Reference B makes use of either a "horizontal bar removably engaging opposing walls of the microwave oven", or a horizontal arm supported by other means protruding into the oven cavity to support a vertical shaft. Although the method for attaching the vertical shaft to a horizontal bar/arm allows for both adjustment of the vertical position of the shaft to meet the optimum stirring capability and security of the shaft's vertical position during operation, the shaft must be located in the attachment before a receptacle is placed into the oven cavity. While the attaching method allows for vertical movement of the shaft, the vertical movement is limited and therefore the shaft together with the presence of the horizontal bar/arm cause significant obstruction to the placement of receptacles within the oven cavity, in practice allowing for the placement within the oven cavity of limited designs of receptacle only. Furthermore, the items comprising the device require potentially more than a simple single movement action to fix them in place.
b. The device at Reference E makes use of either a sprung frame or, when "supplied as original equipment with a microwave oven", a fitment to the oven roof. In either case, the stirring implement of the device is attached via a swinging holder allowing for the stirring implement to be inserted, either before, during or after a receptacle is in place, in a horizontal orientation and rotated to the vertical into a receptacle containing a food/beverage. The design of the prior art does not allow for security of the shaft's vertical position during operation. Use of a frame restricts placement of receptacles within the oven cavity and the requirement for rotation of the device further restricts use of receptacles to only those which enable the rotation ie those with a rim diameter not significantly less than the length of the stirring implement. In particular therefore, the prior art is rendered impracticable for use with tall, narrow receptacles such as jugs and beakers.

c. Much of the prior art does not lend itself to easy cleaning whereas the Microwave Oven Food-Stirrer has been designed such that its external surfaces, particularly those of its permanent fittings are easily accessible.

d. Much of the prior art is located within an oven cavity via a device which bridges, utilises or runs perpendicular to the side walls of the cavity and none of the prior art readily facilitates the adjustment of a stirring device transversely through a receptacle. Where transverse adjustment is permitted, it is in a direction perpendicular to the side walls of the cavity only as opposed to a direction perpendicular to the rear wall of the cavity. Location and subsequent variation of the positioning of a stirring device in a direction perpendicular to the rear wall of the cavity accords with the direction in which receptacles are placed into and removed from the oven, thus facilitating greater ergonomics in the fitment and adjustment process.

While primarily this invention is intended to be a separate stand-alone enhancement able to be fitted retrospectively by a layman to any microwave oven which has a rotary plate as part of its internal features, it could be part-incorporated as an integral design feature of an oven during oven manufacture to provide for either the intended stirring accessory described as the main feature of the invention, or, with further modification to both the invention and a microwave oven, one which is rotated about a vertical axis through an oven roof.

BRIEF SUMMARY OF THE INVENTION

The main feature of the invention is a multi-configurable microwave oven accessory comprising no moving mechanical or electrical parts, the purpose of which is to provide an automated stirring capability for either high or low viscosity foods or beverages held in a receptacle in any size of domestic microwave oven and which:

a. Makes use of the internal rotary plate of a microwave oven to provide a relative motion of a food/beverage.

b. In a singularly configured form comprises:

(1) A Roof-Rail.

(2) A Roof-Fitting.

(3) A Stirring Implement.

c. Is configured from:

(1) A single Roof-Rail being an 'I' sectioned strip having an insignificant effect on the reduction of the volumetric capacity of the oven cavity and not obstructing the placement of items within, which is secured to the ceiling of the microwave oven cavity with adhesive as a permanent fitting along the radial running perpendicular to the back wall of the oven, from the back wall to just beyond the centre thus providing for the ergonomic fitting to it and subsequent adjustment of a Roof-Fitting.

(2) A series of Roof-Fittings designed to ride snugly along the Roof-Rail such that they may be positioned either singularly or in tandem at any point on the rail, except that occupied by another Roof-Fitting, to provide for the optimum stirring capability, varying in length so as to provide for a variation in length of a full configuration of the device along its longitudinal axis and which incorporate a female 'bayonet' type fitting positioned to be facing the front of the oven so as to facilitate easily the attachment of a Stirring Implement.

(3) A series of Stirring Implements varying in design so as to provide for a variation in stirring function of a full configuration of the device and having a male 'bayonet' type fitting incorporated into their design for attachment to Roof Fittings positioned so that on insertion to the female bayonet fitting of the Roof-Fitting, the Stirring Implement is angled to provide the optimum stirring capability within a food/beverage held in a receptacle.

Optional features, the purpose of which is to ensure more fully the relative motion of a food/beverage to the main feature while the latter is in use, are:

a. A non-slip mat to be placed between the receptacle and the oven rotary plate.

b. A Secure Bowl and Rotary Plate assembly, consisting of a studded bowl and a complementing slotted rotary plate. (A Secure Bowl and Rotary Plate assembly would require specific sizing to fit a particular oven and would substitute the original rotary plate fitted to the oven and, for its intended purpose, any receptacle placed within).

All constituent parts of the invention would need to be manufactured in a microwave-proof material.

BRIEF DESCRIPTION OF THE SEVERAL VIEWS OF THE DRAWINGS

The invention is further described by reference to the accompanying drawings in which:

a. FIG. 1 shows the separate elements of a single configuration of the main feature of the invention.

b. FIG. 2 shows front and side views of a Roof Fitting attached to the Roof Rail.

c. FIG. 3 shows a single configuration of the main feature of the invention dispersing heat through a food/beverage held in a receptacle placed on a microwave oven rotary plate.

d. FIG. 4 shows some of the numerous Stirring Implement design options.

e. FIG. 5 shows further Stirring Implement design options.

f. FIG. 6 shows the optional Rotary Plate and Bowl assembly feature.

g. FIG. 7 shows a single configuration of the main feature of the invention in situ with the optional Rotary Plate and Bowl assembly.

DETAILED DESCRIPTION OF THE INVENTION

Referring to the drawings, a single configuration of the main feature of the invention comprises:

a. The Roof-Rail (1) being an 'I' sectioned strip having an insignificant effect on the reduction of the volumetric capacity of the oven cavity and not obstructing the placement of items within, which is secured to the ceiling (14) of the microwave oven cavity with adhesive as a permanent fitting along the radial running perpendicular to the back wall of the oven, from the back wall to just beyond the centre thus providing for the ergonomic fitting to it and subsequent adjustment of a Roof-Fitting (2).

b. A Roof-Fitting (2) designed to ride snugly along the Roof-Rail (1) such that it may be positioned to provide for the optimum stirring capability, selected to provide the desired depth of the invention into the food/beverage to be stirred and which incorporates a female 'bayonet' type fitting positioned to be facing the front of the oven so as to facilitate easily the attachment of a Stirring Implement (3).

c. A Stirring Implement (3) selected to provide the desired stirring function. (Stirring Implements (3) are designed for different mixing/stirring functions and different sized receptacles/bowls. Generally, they are contoured to the walls of different receptacle types in order to provide optimum stirring capability and bring the hotter food toward the centre—see FIG. 3. Of the numerous Stirring Implement design options, some are a 'Whisk-type' (FIG. 4, Item 6), 'Fork-type' (FIG. 4, Item 7), 'Wave-type' (FIG. 4, Item 8), and 'Concave-type' implements (FIG. 4, Item 9). More complex 'aerodynamic' type designs, such as those shown in FIG. 5, Items 10 and 11, are other options for achieving a more even distribution of heat through the food/beverage).

In operation, with the permanent Roof-Rail (1) in place, a single configuration of the invention is positioned to carry out its function by either of the 2 following methods:

a. First attaching a Stirring Implement (3) to a Roof-Fitting (2) and engaging the Stirring Implement (3) and Roof-Fitting (2) securely, thence placing the connected Roof-Fitting (2) and Stirring Implement (3) into a receptacle (4) containing the food/beverage to be stirred, thence placing the receptacle (4) containing the connected Roof-Fitting (2) and Stirring Implement (3) into the oven cavity, thence attaching the connected Roof-Fitting (2) and Stirring Implement (3) to the Roof-Rail (1) via the Roof-Fitting (2), thence positioning the Roof-Fitting (2), with Stirring Implement (3) attached, along the Roof-Rail (1) so as to provide for the optimum stirring capability of the food/beverage in its receptacle (4).

b. First attaching a Roof-Fitting (2) to the Roof-Rail (1), then placing a Stirring Implement (3) into a receptacle (4) containing the food/beverage to be stirred, thence placing the receptacle (4) containing the Stirring Implement (3) into the oven cavity, thence offering the Stirring Implement (3) to the roof-fitting (2) and engaging the Stirring Implement (3) and Roof-Fitting (2) securely, thence positioning the Roof-Fitting (2), with Stirring Implement (3) attached, along the Roof-Rail so as to provide for the optimum stirring capability of the food/beverage in its receptacle (4).

The receptacle (4) which may be used during operation of the Microwave Oven Food-Stirrer is limited in its size and design only by the dimensions of the microwave oven cavity and the fact that its rim must pass under the Roof-Rail (1) and allow sufficient space for fitment of the Roof-Fitting (2) to the Roof-Rail (1) ie, a receptacle (4) may be not greater in height than the distance from the rotary plate (5) on which its sits to just under the 'I' sectioned Roof-Rail (1), this being potentially a little over finger-width from the ceiling (14) of the oven cavity. This is a significant advantage of the Microwave Oven Food Stirrer over the prior art.

A configuration is denied both movement along and about its longitudinal (vertical) axis, excepting that required to connect and disconnect its constituent parts, and pivotal movement about a horizontal axis.

In operating the microwave oven, the rotary plate (5) will provide a motion of the food/beverage within the receptacle (4) relative to the Stirring Implement (3), thus providing for the stirring function of the device and the enhanced dissipation of heat through the food/beverage.

On completion of the cooking period, a single configuration of the invention is removed from the oven by either of the 2 following methods:

a. First decoupling the connected Roof-Fitting (2) and Stirring Implement (3) from the Roof-Rail (1) such that the connected Roof-Fitting (2) and Stirring Implement (3) is retained in the receptacle (4), thence removing the receptacle (4) from the oven cavity, thence removing the connected Roof-Fitting (2) and Stirring Implement (3) from the receptacle (4), thence decoupling the Roof-Fitting (2) from the Stirring Implement (3).

b. First decoupling the Stirring Implement (3) from the Roof-Fitting (2) such that the Stirring Implement (3) is retained in the receptacle (4), thence removing the receptacle (4) from the oven cavity, thence removing the Stirring Implement (3) from the receptacle (4), thence removing the Roof-Fitting (2) from the Roof-Rail (1).

To facilitate a greater capability for stirring a food/beverage, either identical or differing configurations of the connected Roof-Fitting (2) and Stirring Implement (3) may be attached to the Roof-Rail (1) so as to function simultaneously throughout an operating period of the microwave oven.

Should the viscosity of the food/beverage be judged to impair or deny the relative motion of the Stirring Implement (3) to it, through slippage of the chosen receptacle (4) on the rotary plate (5), either of the following optional features of the invention may be employed to ensure a relative motion is maintained:

a. A non-slip mat to be placed between the food receptacle and rotary plate.

b. A Secure Bowl and Rotary Plate assembly, consisting of a studded bowl (12) and a complementing slotted rotary plate (13).

While the invention is intended to be a separate stand-alone enhancement able to be fitted retrospectively by a layman to any microwave oven which has a rotary plate as part of its internal features, to further enhance the stirring capability of the invention in a specific microwave oven, both the invention, and the microwave oven may be modified further to allow for:

a. A variable-speed Rotary Plate. (Designing the rotary plate turning mechanism so that the rotary plate could rotate at various speeds would permit varying speeds of stirring action. Different speeds may be optimised for different food/beverage types).

b. Secondary rotation of the Stirring Implement. (To enhance the stirring/whisking effect, the Microwave Oven Food Stirrer, as an integral part of a microwave oven, could be designed to rotate through its 'point of contact' with the oven roof. In this case, the Roof-Rail (I) would not feature as part of the item).

SEQUENCE LISTING

Not Applicable.

I claim:

1. A microwave oven comprising a microwave oven cavity having a ceiling, means for energizing said oven cavity with microwave energy; a receptacle for holding food, a rotary plate for rotating said receptacle placed thereon within said oven cavity; an apparatus for stirring food in the receptacle while heating with microwave energy, the food stirring apparatus being formed of a microwave compatible material and being configured from a roof-rail, a series roof fittings and a series of stirring implements; said roof-rail being an I-sectioned strip, which is secured to the ceiling of the microwave oven cavity with adhesive as a permanent fitting along the radial running perpendicular to the back wall of the oven cavity; the series of roof-fittings designed to ride snugly along the roof-rail and such that one or more may be positioned at any point on the rail to provide for the optimum food stirring capability, varying in length so as to provide for a variation in length of a full configuration of the apparatus along its longitudinal axis and including a female bayonet-type fitting positioned to be facing the front of the oven cavity so as to facilitate easy attachment of the stirring implement; the series of stirring implements varying in design so as to provide for a variation in stirring function of a full configuration of the apparatus and having a male bayonet-type fitting for attachment with the female bayonet fitting of the roof fitting and which is positioned such that when inserted into the female bayonet fitting of the roof fitting, the stirring implement is aligned within the food in the receptacle so as to provide for the optimum stirring capability of the apparatus.

2. A microwave oven as claimed in claim 1 and for which the receptacle which may be used during operation is limited in its size and design only by the dimensions of the microwave oven cavity and the fact that its rim must pass under the roof-rail and allow sufficient space for fitment of the roof-fitting to the roof-rail.

3. A microwave oven as claimed in claim 2 and for which the food stirring apparatus is denied both movement along and about its longitudinal (vertical) axis, excepting that required to connect and disconnect its constituent parts, and pivotal movement about a horizontal axis.

4. A microwave oven as claimed in claim 3 and for which the food stirring apparatus, by virtue of it design, is supported in total through its contact with the ceiling of the microwave oven cavity and is therefore not reliant on support directly or otherwise from either, the oven floor or walls, or the receptacle containing the food.

5. A microwave oven as claimed in claim 4 and for which access to external surfaces of the food stirring apparatus for cleaning of both the removable parts and those retained in the oven cavity after use is direct and easy.

6. A microwave oven as claimed in claim 5 and for which the stirring Implements of the food stirring apparatus are designed to optimize different stirring functions and are generally contoured to the walls of different receptacle types in order to bring the hotter food toward the centre and which have amongst their designs, 'wave-type', 'whisk-type', 'fork-type', 'concave-type' and 'aerodynamic-type'.

7. A microwave oven as claimed in claim 6 and for which the food stirring apparatus could be part-incorporated as an integral design feature of an oven during oven manufacture to provide for either the intended stationary stirring accessory, one which is rotated about a vertical axis through an oven roof and/or one for which the stirring capability may be varied by providing for a variable-speed rotary plate.

8. A microwave oven as claimed in claim 7 wherein a non-slip mat is placed between the receptacle and the rotary plate to ensure more fully the relative motion of a food/beverage to the stirring apparatus.

9. A microwave oven as claimed in claim 8 wherein a studded bowl and complementary slotted rotary plate are provided to ensure more fully the relative motion of a food/beverage to the stirring apparatus.

10. For use in a microwave oven comprising a microwave oven cavity having a ceiling, means for energizing said oven cavity with microwave energy; a receptacle for holding food, a rotary plate for rotating said receptacle placed thereon within said oven cavity; a multi-configurable accessory for stirring the food in the receptacle while heating with microwave energy comprising a single roof-rail, a series of roof fittings and a series of stirring implements, all being formed of a microwave compatible material; said single roof-rail being an I-sectioned strip to be secured to the ceiling of the microwave cavity with adhesive as a permanent fitting along the radial running from just forward of the center point of the ceiling to the back wall of the oven cavity and meeting the latter at a perpendicular; the series of roof-fittings designed to ride snugly along the roof-rail and such that one or more may be positioned at any point on the rail to provide for the optimum food stirring capability, varying in length so as to provide for a variation in length of a full configuration of the accessory along its longitudinal axis and including a female bayonet-type fitting positioned to be facing the front of the oven cavity so as to facilitate easy attachment of the stirring implement; the series of stirring implements varying in design so as to provide for a variation in stirring function of a full configuration of the accessory and having a male bayonet-type fitting for attachment with the female bayonet fitting of the roof fitting and which is positioned such that when inserted into the female bayonet fitting of the roof fitting, the stirring implement is aligned within the food in the receptacle so as to provide for the optimum stirring capability of the accessory.

11. A multi-configurable microwave oven accessory as claimed in claim 10 and for which the receptacle which may be used during operation is limited in its size and design only by the dimensions of the microwave oven cavity and the fact that its rim must pass under the roof-rail and allow sufficient space for fitment of the roof-fitting to the roof-rail.

12. A multi-configurable microwave oven accessory as claimed in claim 11 and for which a single configuration is denied both movement along and about its longitudinal (vertical) axis, excepting that required to connect and disconnect its constituent parts, and pivotal movement about a horizontal axis.

13. A multi-configurable microwave oven accessory as claimed in claim 12 and which by virtue of it design, is supported in total through its contact with the ceiling of a microwave oven and is therefore not reliant on support directly or otherwise from either, the oven floor or walls, or the receptacle containing the food.

14. A multi-configurable microwave oven accessory as claimed in claim 13 and for which access to external surfaces for cleaning of both the removable parts and those retained in the oven cavity after use is direct and easy.

15. A multi-configurable microwave oven accessory as claimed in claim 14 and for which the Stirring Implements are designed to optimize different stirring functions and are generally contoured to the walls of different receptacle types in order to bring the hotter food toward the centre and which has amongst its stirring Implement designs, 'wave-type', 'whisk-type', 'fork-type', 'concave-type' and 'aerodynamic-type'.

16. A multi-configurable microwave oven accessory as claimed in claim 15 wherein a non-slip mat is placed between the receptacle and the rotary plate to ensure more fully the relative motion of a food/beverage to the stirring apparatus.

17. A multi-configurable microwave oven accessory as claimed in claim 16 wherein a studded bowl and complementary slotted rotary plate are provided to ensure more fully the relative motion of a food/beverage to the stirring apparatus.

* * * * *